United States Patent [19]

Suzuki et al.

[11] 4,345,572

[45] Aug. 24, 1982

[54] ENGINE EXHAUST GAS REFLUX APPARATUS

[76] Inventors: Nagatoshi Suzuki, 5-7-7, Kugahara, Ohta-ku, Tokyo, Japan, 146; Sadaakira Araki, 2081, Izumi, Komae-shi, Tokyo, Japan, 201; Soichi Kawazoe, 452-72, Kazigaya-cho, Totsuka-ku, Yokohama-shi, Kanagawa-ken, Japan, 247

[21] Appl. No.: 217,749

[22] Filed: Dec. 18, 1980

[30] Foreign Application Priority Data

Aug. 7, 1980 [JP] Japan ..... 55-112065[U]

[51] Int. Cl.[3] ..... F02M 25/06; F01N 3/02; F01N 3/12

[52] U.S. Cl. ..... 123/568; 123/569; 123/570; 60/275; 60/279; 60/311

[58] Field of Search ..... 123/568, 570, 571, 569; 60/279, 311, 275

[56] References Cited

U.S. PATENT DOCUMENTS

| | | | |
|---|---|---|---|
| 2,147,671 | 2/1939 | Pratt | 60/311 X |
| 3,100,146 | 8/1963 | Huntington | 60/311 X |
| 3,157,479 | 11/1964 | Boles | 60/275 X |
| 3,162,518 | 12/1964 | Thomas et al. | 60/311 X |
| 3,526,081 | 9/1970 | Kusters | 60/275 X |
| 3,736,727 | 6/1973 | Shriner | 60/311 X |
| 3,892,070 | 7/1975 | Bose | 60/279 X |
| 3,969,096 | 7/1976 | Richard | 60/311 |
| 4,235,845 | 11/1980 | Bose | 60/279 X |

FOREIGN PATENT DOCUMENTS

| | | | |
|---|---|---|---|
| 2505505 | 8/1976 | Fed. Rep. of Germany | 60/311 |
| 2528498 | 1/1977 | Fed. Rep. of Germany | 60/278 |
| 2833481 | 2/1980 | Fed. Rep. of Germany | 60/311 |
| 1334472 | 10/1973 | United Kingdom | 60/311 |

*Primary Examiner*—Wendell E. Burns
*Attorney, Agent, or Firm*—Lane, Aitken, Kice & Kananen

[57] ABSTRACT

This patent specification discloses an engine exhaust gas reflux apparatus constructed so as to purify exhaust gas coming out of various engines mounted on vehicles or ships for preferably preventing $NO_x$ from being discharged in the atmosphere.

The engine exhaust gas reflux apparatus has a technical construction which removes dust particles and impurities contained in exhaust gas by means of a dust collector installed at the discharge port of the exhaust manifold, draws purified exhaust gas into the intake manifold and lowers combustion temperature produced when the engine fuel burns to eliminate $NO_x$ out of exhaust gas coming out of the exhaust manifold.

6 Claims, 1 Drawing Figure

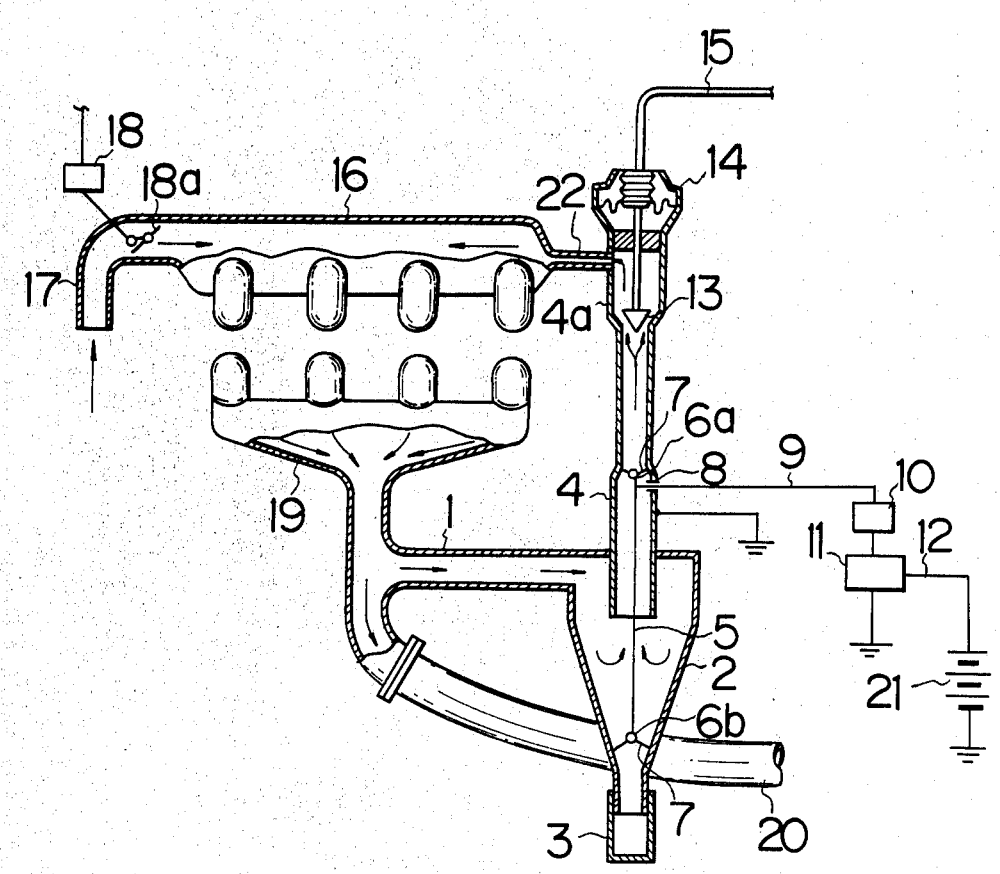
15
18
18a
16
22
14
17
4a
13
7
6a
9
8
10
4
19
1
11
12
5
2
21
6b
7
20
3

ENGINE EXHAUST GAS REFLUX APPARATUS

BACKGROUND OF THE INVENTION

1. Field of the Invention

This invention relates to a novel engine exhaust gas reflux apparatus available for purifying exhaust gas coming out of various vehicle and marine engines, especially automobile diesel engines and gasoline engines and feeding this purified exhaust gas into an intake manifold.

More particularly, the present invention provides an engine exhaust gas reflux apparatus which has been so constructed as to purify exhaust gas discharged out of an exhaust manifold by means of a cyclone type dust collecting drum in accordance with the discharge theory of static electricity, feed this purified exhaust gas into the engine through an intake manifold and burn fuel flowing into this engine at a low temperature thereby to remove $NO_x$ gas contained in the exhaust gas.

2. Description of the Prior Art

Heretofore, the engine exhaust gas reflux apparatus of the type described above has not been used practically either for vehicles or ships. As a result, the exhaust gas coming out of various engines has been discharged into the air, as it is through an exhaust manifold, exhaust pipe, discharge pipe, etc.

It has been made clear from the survey made so far that this exhaust gas contained nitrogen oxide, i.e., $NO_x$ has a serious effect on the human body.

Also, dust particles and/or tarry black smoke contained in the exhaust gas have caused a public nuisance including air pollution, etc.

In addition, there is a grave doubt whether a carcinogen or carcinogenic factor is contained in said exhaust gas, and it is now a matter of the utmost public concern.

SUMMARY OF THE INVENTION

It is an object of the present invention to provide an engine exhaust gas reflux apparatus characterized in that a part of exhaust gas coming out of various vehicle and marine engines, more particularly, diesel engines and gasoline engines mounted on automobiles and further motorcycle engines is purified by means of a cyclone type dust collecting drum, this purified exhaust gas being fed into an intake manifold through an electrostatic filter type discharge pipe and a control valve, and nitrogen oxide, i.e., $NO_x$ contained in exhaust gas discharged as it is from the engine being removed to emit a clean exhaust gas.

It is another object of the present invention to provide an engine exhaust gas reflux apparatus provided with a cyclone type dust collecting drum in the flow passage of the exhaust gas of the engine to purify the engine exhaust gas with a dust collector which ensures a high dust collecting efficiency and can be made in compact size reasonably.

It is a further object of the present invention to provide an engine exhaust gas reflux apparatus constructed so as to branch the exhaust pipe of the exhaust manifold to allow a cyclone type dust collecting drum to draw a part of the exhaust gas coming out of said exhaust manifold and at the same time, discharge the other part of the aforesaid exhaust gas into the air through an exhaust gas leading pipe.

It is a still further object of the present invention to provide an engine exhaust gas reflux apparatus fitted with a valve controller for a control valve adapted to regulate the inflow of the engine exhaust gas, whereby adjustment of the opening of said control valve is accomplished smoothly and the inflow of the exhaust gas can be controlled properly.

BRIEF DESCRIPTION OF THE DRAWING

The drawing shows a generally diagrammatic representation of the engine exhaust gas reflux apparatus of the present invention, and this is a sectional view showing the preferred embodiment of the present invention.

DESCRIPTION OF THE PREFERRED EMBODIMENTS

The present invention is directed to an engine exhaust gas reflux apparatus constructed so as to purify the exhaust gas of various engines, for example, automobile diesel and gasoline engines and further marine engines, and to draw this purified exhaust gas into an intake manifold. Generally, the exhaust gas coming out of the engines of vehicles, especially automobiles, is discharged into the atmosphere, as it is through an exhaust manifold, exhaust pipe and discharge pipe.

This exhaust gas contains various impurities including nitrogen oxide, i.e., $NO_x$ which have hitherto affected seriously the health of pedestrians, etc.

Also, dust particles and/or tarry black smoke contained in exhaust gas have brought about a public nuisance arising from the air pollution. What's more, a suspicion has recently been strengthened that some carcinogen is included in the exhaust gas, and it is being watched with great interest by the people.

The present invention has been made to get the problems described above out of the way and provides an engine exhaust gas reflux apparatus featuring the ability to purify exhaust gas coming out of the exhaust manifold, feed this purified exhaust gas into the automobile diesel and gasoline engines through the intake manifold and burn a fuel brought into said engines thereby to prevent nitrogen oxide, i.e., $NO_x$ from being discharged together with the exhaust gas.

There is given hereunder a detailed description of the construction of the preferred embodiment of engine exhaust gas reflux apparatus of the present invention in association with reference numerals in the drawing.

An exhaust gas inducing pipe 1 and one branched passage thereof communicates with the upper portion of a cyclone type dust collecting drum 2. Also, the other branched passage is connected to an exhaust gas leading pipe 20. A dust sump 3 is fitted at the bottom of said cyclone type dust collecting drum 2 and is available for collecting dust particles. An electrostatic filter type discharge pipe 4 extends out of the upper face of the aforesaid cyclone type dust collecting drum 2 and is kept fixed firmly. A discharge wire 5 connects an insulator *6a* fitted to the electrostatic filter type discharge pipe 4 and an insulator *6b* attached to the lower portion of the cyclone type dust collecting drum 2.

A plurality of pieces 7 substantially used for supporting the abovementioned insulators *6a* and *6b* extend radially from the insulators *6a* and *6b*.

The other ends of the plurality of supporting pieces 7 are secured to the side walls of the electrostatic filter type discharge pipe 4 and the lower side walls of the cyclone type dust collecting drum 2. A cylindrical insulator 8 is embedded in the side wall of the electrostatic filter type discharge pipe 4 for the purpose of insulating protection. This cylindrical insulator 8 enables a high-tension cable 9 to be connected easily to the discharge wire 5.

The output side of a rectifier 10 is connected to the high-tension cable 9 and, at the same time, the input side is connected to a high voltage generator 11.

One end of a power cable 12 is connected to said high voltage generator 11 and the other end to a power source 21, respectively. A control valve 13 is installed on a certain part of the electrostatic filter type discharge pipe 4 and is available for controlling the inflow of exhaust gas. A valve controller 14 is linked to said control valve 13 to adjust the opening of the control valve. A vacuum communicating pipe 15 is used for controlling exhaust gas flowing back in the engine working condition, and it is connected to the abovementioned valve controller 14.

An intake manifold 16 having an intake inlet 17 at the one end thereof is adapted to mix the air drawn in with circulated exhaust gas and to introduce the mixture into the combustion chamber of the engine.

The other end of said intake manifold 16 is formed in an integral piece with an exhaust gas flowing pipe 22. Moreover, said exhaust gas flowing pipe 22 is joined to a side wall 4*a* of the electrostatic filter type discharge pipe 4. An intake regulator 18 controls a throttle 18*a* for intake regulation installed inside the aforesaid intake inlet 17.

The intake from the outside can be regulated preferably by adjusting the inclination of said intake regulation throttle 18*a*.

Exhaust gas is discharged out of the combustion chamber of the engine through an exhaust manifold 19. The lower portion of the exhaust manifold 19 is made in one integral piece with the exhaust gas inducing pipe 1 to direct a part of exhaust gas into the cyclone type dust collecting drum 2 and at the same time, discharge the remainder of the exhaust gas into the air. The exhaust manifold has such function as described above.

An exhaust gas leading pipe 20 is connected to said exhaust manifold 19 to form a discharging passage of exhaust gas.

Next, there is given a description of the operation of the engine exhaust gas reflux apparatus of the present invention.

A part of the exhaust gas discharged from the combustion chamber of a diesel or gasoline engine of an automobile through the exhaust manifold 19 flows into the cyclone type dust collecting drum 2 via the exhaust gas inducing pipe 1, and high voltage, e.g. voltage of 4000 to 10000 volts, is applied to the discharge wire 5 from the power source 21 through the high voltage generator 11, rectifier 10 and high-tension cable 9. Then, a strong electrostatic field is produced across said discharge wire 5 and the cyclone type dust collecting drum 2, and dust particles and/or tarry black smoke contained in the exhaust gas stick to the inside of the electrostatic filter type discharge pipe 4 as well as the cyclone type dust collecting drum 2, and these unwanted substances are collected in the dust sump 3 installed at the bottom of the drum.

According to the test results, tarry black smoke and also dust particles of about 0.01 micron in grain size contained in the exhaust gas can be removed completely.

The purified exhaust gas is fed into the intake manifold 16 via the electrostatic filter type discharge pipe 4 and the control valve 13.

The inflow of this exhaust gas actuates the valve controller 14 with the negative pressure of the vacuum communicating pipe 15, whereby the opening of the control valve 13 can be adjusted automatically.

Since the exhaust gas has thus been purified, there is substantially no possibility of the control valve 13 being fouled by tarry black smoke and/or dust particles, the purification thus providing a very smooth adjustment of the opening of the control valve 13 and further ensuring a correct action at all times.

On the other hand, the outside air or fuel is drawn in through the intake inlet 17 of the intake manifold 16 and the intake regulation throttle 18*a* is controlled by the action of the intake regulator 18, resulting in the inflow being controlled properly.

In addition circulated exhaust gas and air are led into the combustion chamber of the engine via the intake manifold 16. In this case, a great quantity of ions are generated by the action of the discharge wire 5 arranged inside the electrostatic filter discharge pipe 4 to ionize a mixed fuel passing through the intake manifold 16. The result is that the combustion efficiency of engine is greatly enhanced and the engine output also increases.

In this condition, the purified exhaust gas provides an effect which lowers the combustion temperature of the fuel-air mixture drawn in the engine, thus making it possible to reduce noticeably nitrogen oxide, i.e. $NO_x$, contained in the exhaust gas coming out of the exhaust manifold 19.

Accordingly, even when the exhaust gas is discharged into the atmosphere through the exhaust gas leading pipe 20, it results in gas containing $NO_x$ being not emitted.

This invention is not limited to the preferred embodiment described hereinbefore and, for example, by installing an air cleaner such as a dust collecting drum on the exhaust gas leading pipe 20, the exhaust gas can preferably be purified with even higher efficiency and further purification of the exhaust gas is achieved more promptly. The engine exhaust gas reflux apparatus of the present invention features the construction and action described above and offers the following advantages.

Namely, the apparatus is so constructed as to connect the cyclone type dust collecting drum with the exhaust manifold through the exhaust gas inducing pipe, and to fit the electrostatic filter type discharge pipe to said cyclone type dust collecting drum in order to direct the exhaust gas back to the intake manifold via the control valve. Thus, it can lower the combustion temperature generated when the engine fuel burns, thereby negating the chance of nitrogen oxide, i.e., $NO_x$ being mixed in the exhaust gas and eliminating the possibility of the health of pedestrians being affected seriously. Futhermore, it contributes to overcoming the pollutional problems including air pollution. Moreover, since as tarry black smoke dust and/or dust particles have already been removed from the exhaust gas, there is no possibility of these unwanted substances adhering to the control valve. It ensures correct operation of the control valve along with a smooth adjustment of the opening of the control valve.

Further, the preferred embodiment of the present invention is applicable to various automobile engines, is not limited to the diesel engine, and has a wide range of applications.

Still further, it is also possible to install a dust collector at the exhaust port of exhaust gas leading pipe to purify the exhaust gas with even higher efficiency.

Although the invention has been described in detail herein with reference to a preferred embodiment thereof, it is to be understood that the invention is not limited to the precise embodiment described herein and that variations and modifications may be effected within the spirit and scope of the invention as described hereinabove and as defined in the following claims.

What is claimed is:

1. An engine exhaust gas reflux apparatus provided with an exhaust manifold, a dust collector linked to said exhaust manifold and a control valve and substantially comprising an electrostatic filter type discharge pipe connected to said dust collector and an intake manifold available for drawing exhaust gas from said electrostatic filter type discharge pipe thereby to preferably reduce $NO_x$ contained in exhaust gas.

2. An engine exhaust gas reflux apparatus provided with an exhaust manifold, a cyclone type dust collecting device linked to said exhaust manifold, a high voltage generating circuit for the dust collecting action of said cyclone type dust collecting device and a control valve and substantially comprising an electrostatic filter type discharge pipe connected to said cyclone type dust collecting device and an intake manifold working to induce exhaust gas from said electrostatic filter type discharge pipe thereby to preferably reduce $NO_x$ contained in exhaust gas.

3. An engine exhaust gas reflux apparatus provided with an exhaust manifold including two passages branched from a discharge port, a dust collector connected to one branched passage from the discharge port of said exhaust manifold, a exhaust gas leading pipe connected to the other branched passage from the discharge port of the exhaust manifold and a control valve and substantially comprising an electrostatic filter type discharge pipe linked to said dust collector and an intake manifold available for introducing exhaust gas from said electrostatic filter type discharge pipe thereby to preferably reduce $NO_x$ contained in exhaust gas.

4. An engine exhaust gas reflux apparatus according to claim 3 wherein a dust collector is substantially installed in the other branched passage of discharge port of aforesaid exhaust manifold.

5. An engine exhaust gas reflux apparatus according to claim 1, 2 or 3 wherein a control valve fitted to said electrostatic filter type discharge pipe is substantially so constructed that the opening of the valve can be adjusted by means of a valve controller.

6. An engine exhaust gas reflux apparatus according to claim 1, 2 or 3 wherein a throttle for intake adjustment is substantially installed inside the intake inlet port of aforesaid intake manifold.

* * * * *